US011188016B2

(12) United States Patent
Ishida

(10) Patent No.: US 11,188,016 B2
(45) Date of Patent: Nov. 30, 2021

(54) FIXING DEVICE INCLUDING A HEATER HAVING A PLANAR SHAPE AND AN ENDLESS BELT

(71) Applicant: Brother Kogyo Kabushiki Kaisha, Nagoya (JP)

(72) Inventor: Kei Ishida, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/918,046

(22) Filed: Jul. 1, 2020

(65) Prior Publication Data

US 2021/0003952 A1 Jan. 7, 2021

(30) Foreign Application Priority Data

Jul. 5, 2019 (JP) ..... JP2019-126432

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01); *G03G 2215/2038* (2013.01)

(58) Field of Classification Search
CPC ..... G03G 15/2053; G03G 15/2064; G03G 2215/2038; G03G 2215/2016; G03G 2215/2035
See application file for complete search history.

(56) References Cited

U.S. PATENT DOCUMENTS 5,907,348 A * 5/1999 Ogasawara et al. ..... G03G 15/2064 347/212
10,838,332 B2 * 11/2020 Umeda ..... G03G 15/2064
2005/0163540 A1 * 7/2005 Umezawa et al. ..... G03G 15/2064 399/328
2011/0206406 A1 * 8/2011 Suzuki ..... G03G 15/2064 399/90
2011/0297663 A1 * 12/2011 Ito ..... G03G 15/2053 219/216
2015/0277309 A1 10/2015 Kuroda
2020/0249602 A1 * 8/2020 Inoue ..... G03G 15/657

FOREIGN PATENT DOCUMENTS

JP 2015-191734 A 11/2015

* cited by examiner

*Primary Examiner* — Walter L Lindsay, Jr.
*Assistant Examiner* — Laura Roth
(74) *Attorney, Agent, or Firm* — Burr & Brown, PLLC

(57) ABSTRACT

A fixing device includes: a heater including (i) a substrate having conductivity, (ii) a first insulating layer provided on a first surface of the substrate, and (iii) a heating pattern constituted by a heating resistor and provided on an opposite side of the first insulating layer from the substrate; and an endless belt configured to rotate around the heater in a state in which an inner circumferential surface of the endless belt is in contact with the heater. The substrate is grounded.

5 Claims, 6 Drawing Sheets

FIXING DEVICE INCLUDING A HEATER HAVING A PLANAR SHAPE AND AN ENDLESS BELT

CROSS REFERENCE TO RELATED APPLICATION

The present application claims priority from Japanese Patent Application No. 2019-126432, which was filed on Jul. 5, 2019, the disclosure of which is herein incorporated by reference in its entirety.

BACKGROUND

The following disclosure relates to a fixing device including a heater having a planar plate shape.

There are conventionally known heaters used for a fixing device which include: a substrate formed of metal as a conductive material; an insulating layer formed on the substrate; and a heating resistor formed on the insulating layer.

SUMMARY

In the heater in which the substrate is formed of a conductive material, however, the substrate in some cases functions as an antenna to diffuse radiation noise.

Accordingly, an aspect of the disclosure relates to a fixing device that reduces radiation noise.

In one aspect of the disclosure, a fixing device includes: a heater including (i) a substrate having conductivity, (ii) a first insulating layer provided on a first surface of the substrate, and (iii) a heating pattern constituted by a heating resistor and provided on an opposite side of the first insulating layer from the substrate; and an endless belt configured to rotate around the heater in a state in which an inner circumferential surface of the endless belt is in contact with the heater. The substrate is grounded.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
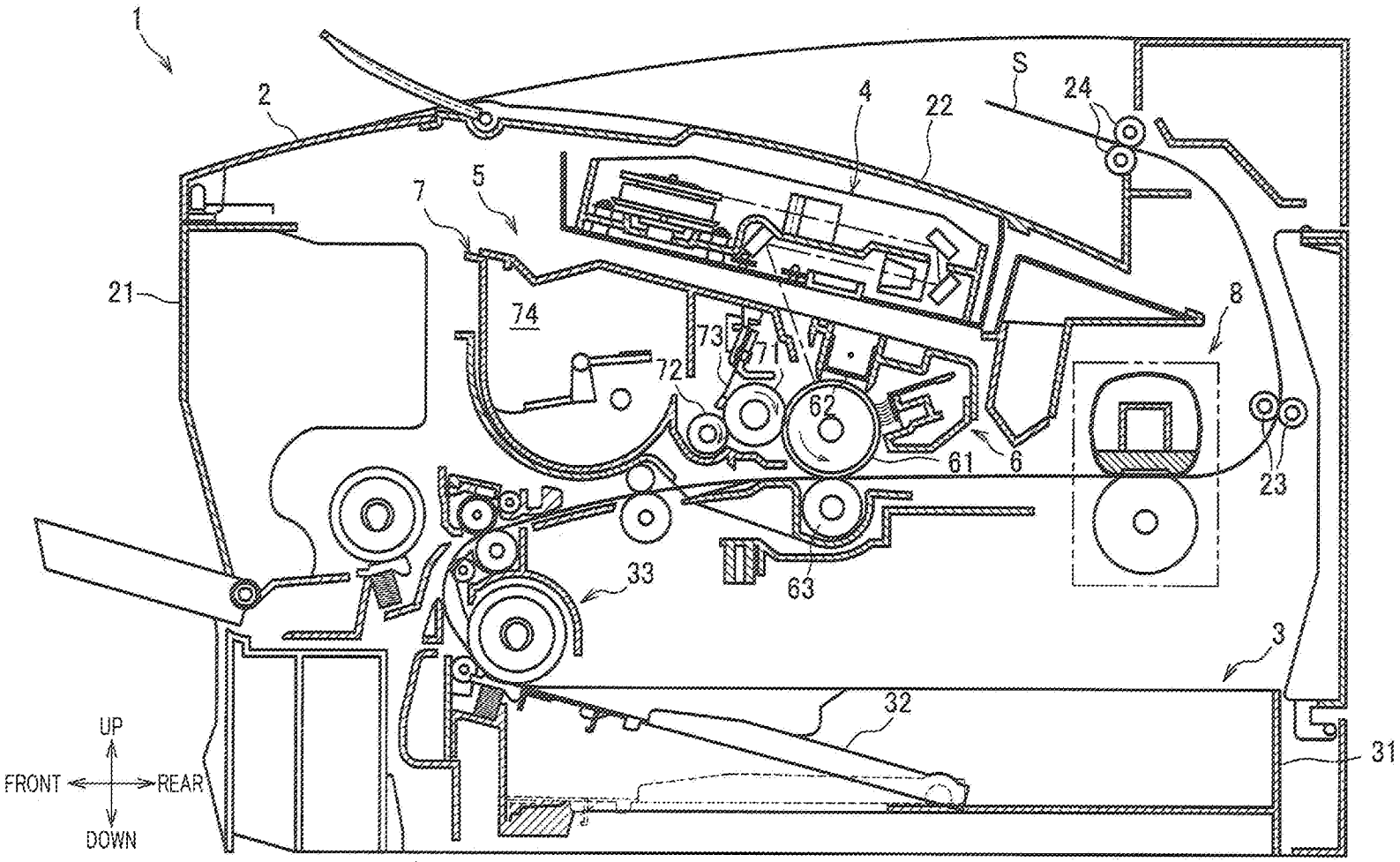
FIG. 1 is a cross-sectional view of a laser printer according to a first embodiment.

Hereinafter, there will be described embodiments by reference to the drawings. First, a first embodiment will be described. As illustrated in FIG. 1, a laser printer 1 includes a supplier 3, an exposing device 4, a process cartridge 5, and a fixing device 8 in a housing 2.

The supplier 3 is provided at a lower portion of the housing 2 and includes a supply tray 31 for accommodating sheets S, a pressing plate 32, and a supply mechanism 33. The sheet S accommodated in the supply tray 31 is moved upward by the pressing plate 32 and supplied into the process cartridge 5 by the supply mechanism 33.

The exposing device 4 is disposed at an upper portion of the housing 2 and includes a light source device, not illustrated, and a polygon mirror, a lens, a reflective mirror, and so on illustrated without reference numerals. The exposing device 4 exposes a surface of a photoconductor drum 61 by scanning the surface of the photoconductor drum 61 at high speed with a light beam emitted from the light source device based on image data.

The process cartridge 5 is disposed below the exposing device 4 and removably mountable in the housing 2 through an opening that is formed when opening a front cover 21 provided on the housing 2. The process cartridge 5 includes a drum unit 6 and a developing unit 7. The drum unit 6 includes the photoconductor drum 61, a charging unit 62, and a transfer roller 63. The developing unit 7 is mountable to and removable from the drum unit 6 and includes a developing roller 71, a supply roller 72, a layer-thickness limiting blade 73, and a container 74 containing toner.

In the process cartridge 5, the surface of the photoconductor drum 61 is uniformly charged by the charging unit 62 and then exposed by the light beam emitted from the exposing device 4 to form an electrostatic latent image on the photoconductor drum 61 based on the image data. The toner in the container 74 is supplied to the developing roller 71 by the supply roller 72 so as to enter a position between the developing roller 71 and the layer-thickness limiting blade 73, so that the toner is born on the developing roller 71 as a thin layer having a specific thickness. The toner born on the developing roller 71 is supplied from the developing roller 71 to the electrostatic latent image formed on the photoconductor drum 61. This visualizes the electrostatic latent image, thereby forming a toner image on the photoconductor drum 61. The sheet S is thereafter conveyed between the photoconductor drum 61 and the transfer roller 63, so that the toner image formed on the photoconductor drum 61 is transferred to the sheet S.

The fixing device 8 is disposed downstream of the process cartridge 5 in a conveying direction of the sheet S. The toner image is fixed while the sheet S to which the toner image is transferred is passing through the fixing device 8. The sheet S to which the toner image is fixed is discharged onto an output tray 22 by conveying rollers 23, 24.

Figure 2:
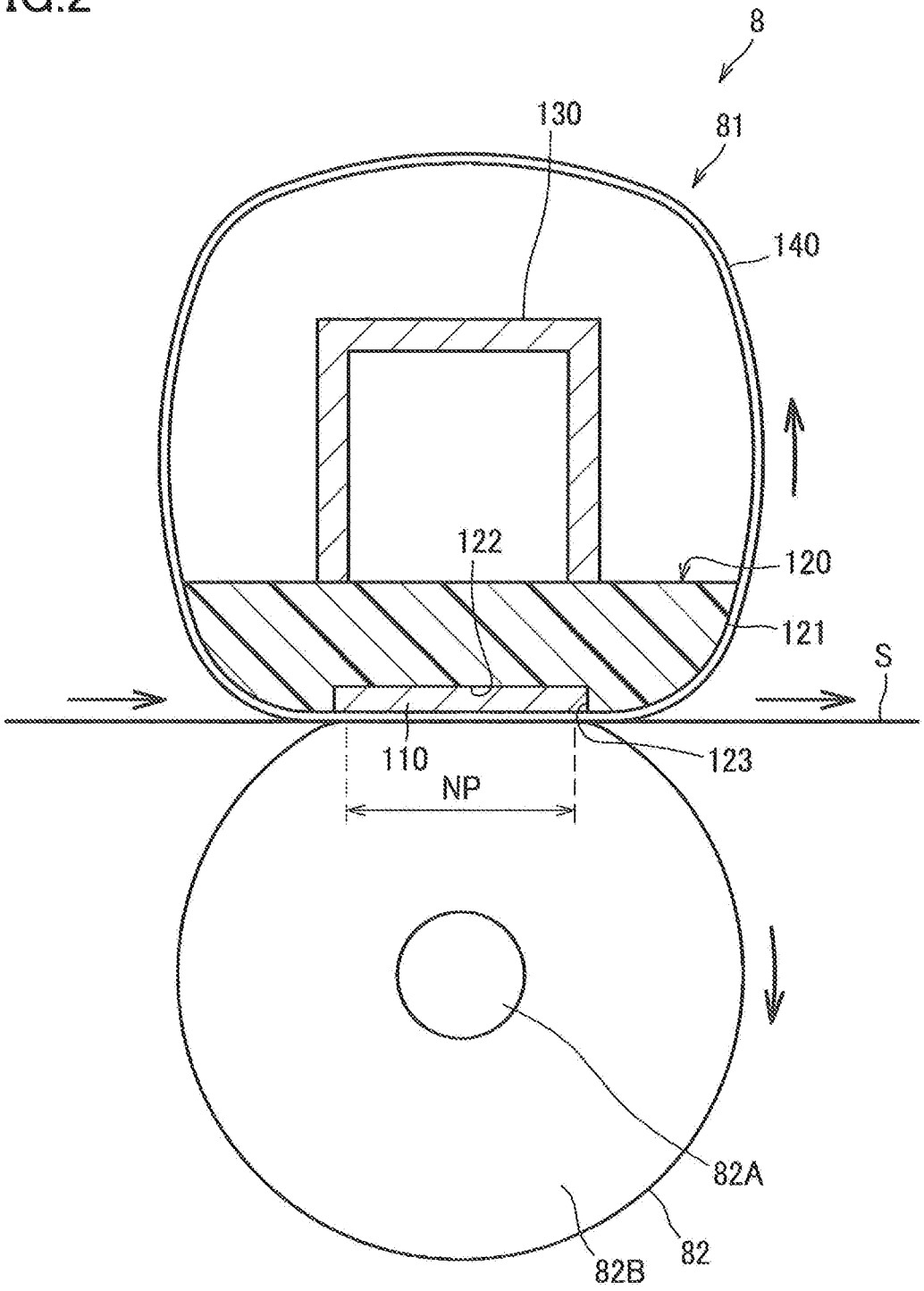
FIG. 2 is a cross-sectional view of a fixing device.

As illustrated in FIG. 2, the fixing device 8 includes a heating unit 81 and a pressure roller 82. One of the heating unit 81 and the pressure roller 82 is urged to the other by an urging mechanism, not illustrated.

The heating unit 81 includes a heater 110, a holder 120, a stay 130, and a belt 140. The heater 110 is of a planar plate shape and supported by the holder 120. It is noted that the configuration of the heater 110 will be described later in detail.

The holder 120 is formed of resin and has a guide surface 121 being in contact with an inner circumferential surface of the belt 140 to guide the belt 140. The holder 120 has heater supporting surfaces 122, 123 supporting the heater 110. The heater supporting surface 122 supports the heater 110 by contacting one of opposite surfaces of the heater 110 which is farther from the pressure roller 82 than the other. The heater supporting surface 123 supports the heater 110 by contacting the heater 110 in the conveying direction of the sheet S.

The stay 130 is a member for supporting the holder 120 and formed by bending a plate member having stiffness greater than that of the holder 120, e.g., steel sheet, in a substantially U-shape in cross section.

The belt 140 is an endless belt having heat resistance and flexibility and including a base member and a fluororesin layer covering the base member. The base member may be formed of any of heatproof resin such as polyimide and metal such as stainless steel. The heater 110, the holder 120, and the stay 130 are disposed on an inner side of the belt 140. The belt 140 rotates around the heater 110 in a state in which the inner circumferential surface of the belt 140 is in contact with the heater 110.

The pressure roller 82 includes a metal shaft 82A and an elastic layer 82B covering the shaft 82A. The belt 140 is nipped between the pressure roller 82 and the heater 110 to form a nip portion NP for heating and pressurizing the sheet S.

The pressure roller 82 is driven and rotated by a driving force transmitted from a motor, not illustrated, provided in the housing 2. When the pressure roller 82 is driven, the belt 140 is rotated by a frictional force between the pressure roller 82 and the belt 140 (or the sheet S). As a result, the sheet S to which the toner image is transferred is conveyed between the pressure roller 82 and the heated belt 140, whereby the toner image is heat-fixed.

Figure 3:
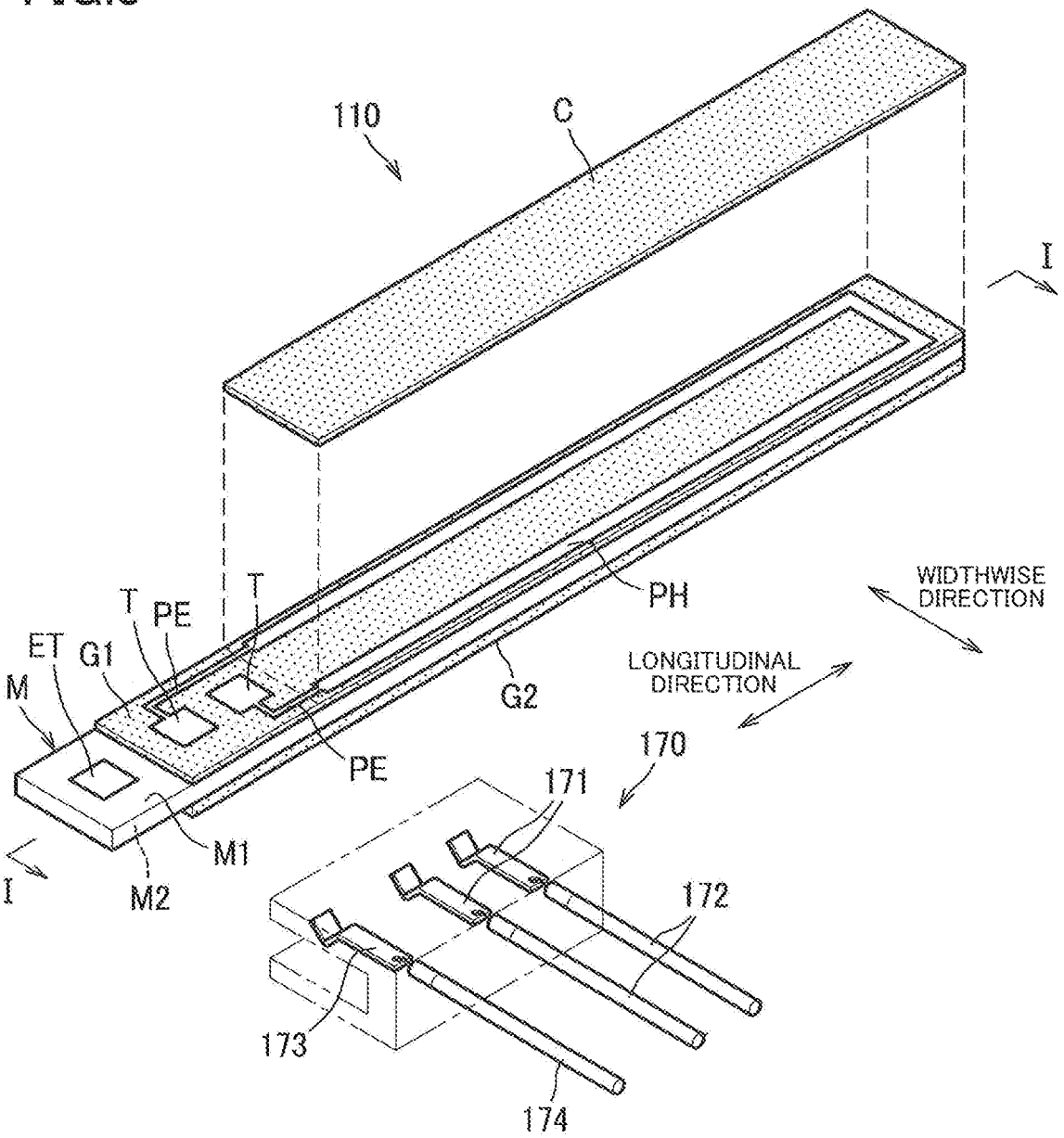
FIG. 3 is a partly-exploded perspective view of a heater and a perspective view of a connector.
Figure 4:
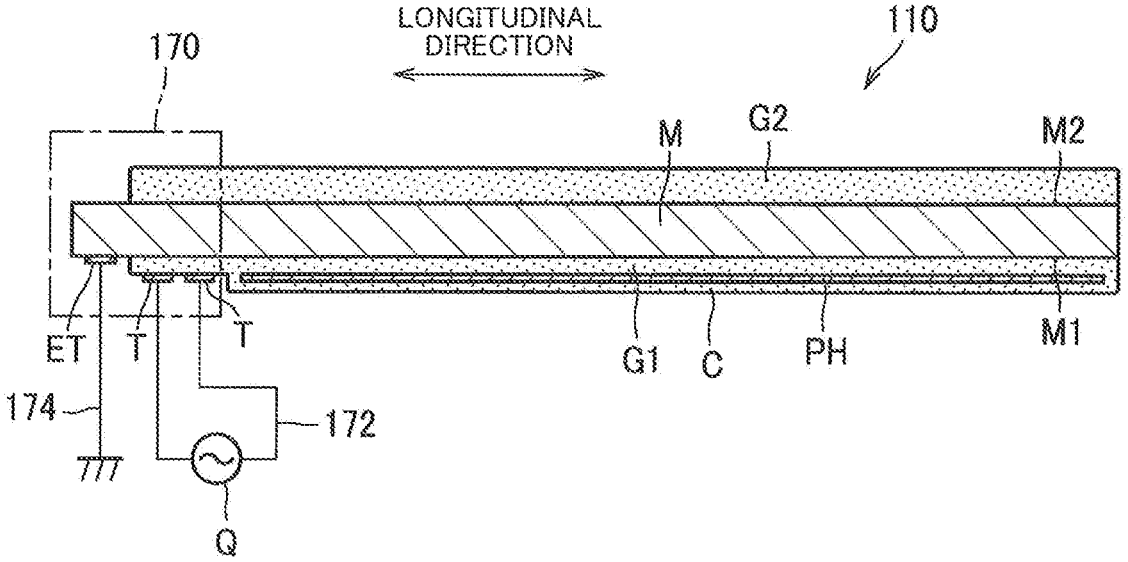
FIG. 4 is a cross-sectional view taken along line I-I in FIG. 3.

As illustrated in FIGS. 3 and 4, the heater 110 includes a substrate M, a first insulating layer G1, a second insulating layer G2, heating patterns PH, power-supply patterns PE, power-supply terminals T (each as one example of a first terminal), a grounding terminal ET (as one example of a second terminal), and a protecting layer C.

The substrate M has an elongated shape. In the present embodiment, the substrate M is a flat plate having an elongated rectangular shape. The substrate M has opposite surfaces, namely, a first surface M1 and a second surface M2. Each of the first surface M1 and the second surface M2 is orthogonal to a direction in which the heating unit 81 and the pressure roller 82 are arranged. In the present embodiment, the heater 110 is disposed such that the first surface M1 of the substrate M faces toward the pressure roller 82. In the following description, the longitudinal direction and the widthwise direction of the substrate M may be referred to simply as "longitudinal direction" and "widthwise direction", respectively. In the present embodiment, the longitudinal direction coincides with the direction of the rotation axis of the pressure roller 82, i.e., the direction in which the shaft 82A extends. The widthwise direction coincides with the direction in which the belt 140 moves at the nip portion NP.

The substrate M has conductivity. The substrate M is formed of metal, for example. In the present embodiment, the substrate M is formed of stainless steel. The substrate M is grounded via the grounding terminal ET which will be described below. It is noted that the word "grounded" means electrical connection to a portion of a body of the laser printer 1 at a reference electric potential, e.g., a ground potential. The substrate M may be connected via a resistor to the portion at the reference electric potential.

The first insulating layer G1 is an insulating member formed of glass material, for example. The first insulating layer G1 is provided on the first surface M1 of the substrate M. The first insulating layer G1 is less than the substrate M in length in the longitudinal direction. One end portion of the substrate M in the longitudinal direction is flush with the first insulating layer G1. The first insulating layer G1 is disposed so as to cover the one end portion of the substrate M and not to cover the other end portion of the substrate M to expose the other end portion.

The second insulating layer G2 is an insulating member formed of glass material. The second insulating layer G2 is provided on the second surface M2 of the substrate M.

The heating patterns PH, the power-supply patterns PE, and the power-supply terminals T are provided on an opposite side of the first insulating layer G1 from the substrate M. Each of the heating patterns PH is a heating resistor that generates heat when energized. In the present embodiment, each of the heating patterns PH is a rectangular pattern extending in the longitudinal direction of the substrate M. The two heating patterns PH are provided on the first insulating layer G1 so as to be spaced apart from each other in the widthwise direction of the substrate M.

Each of the power-supply patterns PE is a pattern for electrically connecting a corresponding one of the power-supply terminals T and a corresponding one of the heating pattern PH to each other. The power-supply pattern PE is disposed between the power-supply terminal T and the heating pattern PH in the longitudinal direction of the substrate M. Each of the power-supply patterns PE and the power-supply terminals T is formed of a conductive material that is less than a material of the heating patterns PH in resistance value.

The protecting layer C is an insulating member formed of glass material and covering the heating patterns PH and portions of the power-supply patterns PE. The protecting layer C contacts the belt 140. It is noted that the protecting layer C is preferably formed of a material having a high slidability on the inner circumferential surface of the belt 140, such as a glass material.

The power-supply terminals T are for supplying electricity to the respective heating patterns PH. The power-supply terminals T are located at the other end portion of the substrate M in the longitudinal direction. In the present embodiment, the two power-supply terminals T are provided on the other end portion of the substrate M in the longitudinal direction. The power-supply terminals T are provided on the first surface M1 of the substrate M with the first insulating layer G1 interposed therebetween. The power-supply terminals T are electrically continuous to the respective heating patterns PH via the respective power-supply patterns PE. In the present embodiment, the power-supply terminals T are formed by plating the first insulating layer G1 with metal such as copper. As illustrated in FIG. 4, the power-supply terminals T are connectable to a connector 170 so as to be connected to a power source Q in the housing 2 by power-supply wires 172 of the connector 170.

The grounding terminal ET is provided on the other end portion of the substrate M in the longitudinal direction. The grounding terminal ET is provided on the first surface M1 of the substrate M and electrically continuous to the substrate M. In the present embodiment, the grounding terminal ET is formed on the first surface M1 of the substrate M at a position not covered with the first insulating layer G1, and is formed by plating the substrate M with metal such as copper, for example. As illustrated in FIG. 4, the grounding terminal ET is connectable to the connector 170 and grounded via a ground wire 174 of the connector 170. In other words, the grounding terminal ET is connected to the ground potential. It is noted that, as illustrated in FIG. 4, the position at which the grounding terminal ET is disposed is nearer in the longitudinal direction to the other end portion of the substrate M in the longitudinal direction than the positions at which the power-supply terminals T are disposed. In other words, the positions at which the power-supply terminals T are disposed are nearer in the longitudinal direction to the center of the substrate M in the longitudinal direction than the position at which the grounding terminal ET is disposed.

As illustrated in FIG. 3, the connector 170 includes power-supply electrodes 171, the power-supply wires 172, a ground electrode 173, and the ground wire 174. When the connector 170 is connected to the heater 110, the power-supply electrodes 171 is in contact with the respective power-supply terminals T, and the ground electrode 173 is in contact with the grounding terminal ET.

There will be next described operations and effects of the fixing device 8 according to the present embodiment. In the case where the heater 110 of the fixing device 8 includes the substrate M having conductivity, the substrate M in some cases functions as an antenna to diffuse radiation noise. In the fixing device 8 according to the present embodiment, however, the conductive substrate M is grounded, resulting in reduced radiation noise.

The grounding terminal ET that grounds the substrate M and the power-supply terminals T for supplying electricity to the substrate M is provided on the first surface M1 of the substrate M. In the case where the power-supply electrodes 171 and the ground electrode 173 of the connector 170 are connected respectively to the power-supply terminals T and the grounding terminal ET, the electrodes 171, 173 can be brought into contact respectively with the grounding terminal ET and the power-supply terminals T from the same side.

There will be next described a second embodiment. It is noted that the same reference numerals as used in the first embodiment are used to designate the corresponding elements of the second embodiment, and an explanation of which is dispensed with.

While the substrate M is grounded via the grounding terminal ET in the first embodiment, the substrate M may be grounded via the belt, for example. For example, the substrate M is grounded via a belt 240 in a heater 210 of a heating unit 281 in the second embodiment illustrated in FIG. 5.

Figure 5:
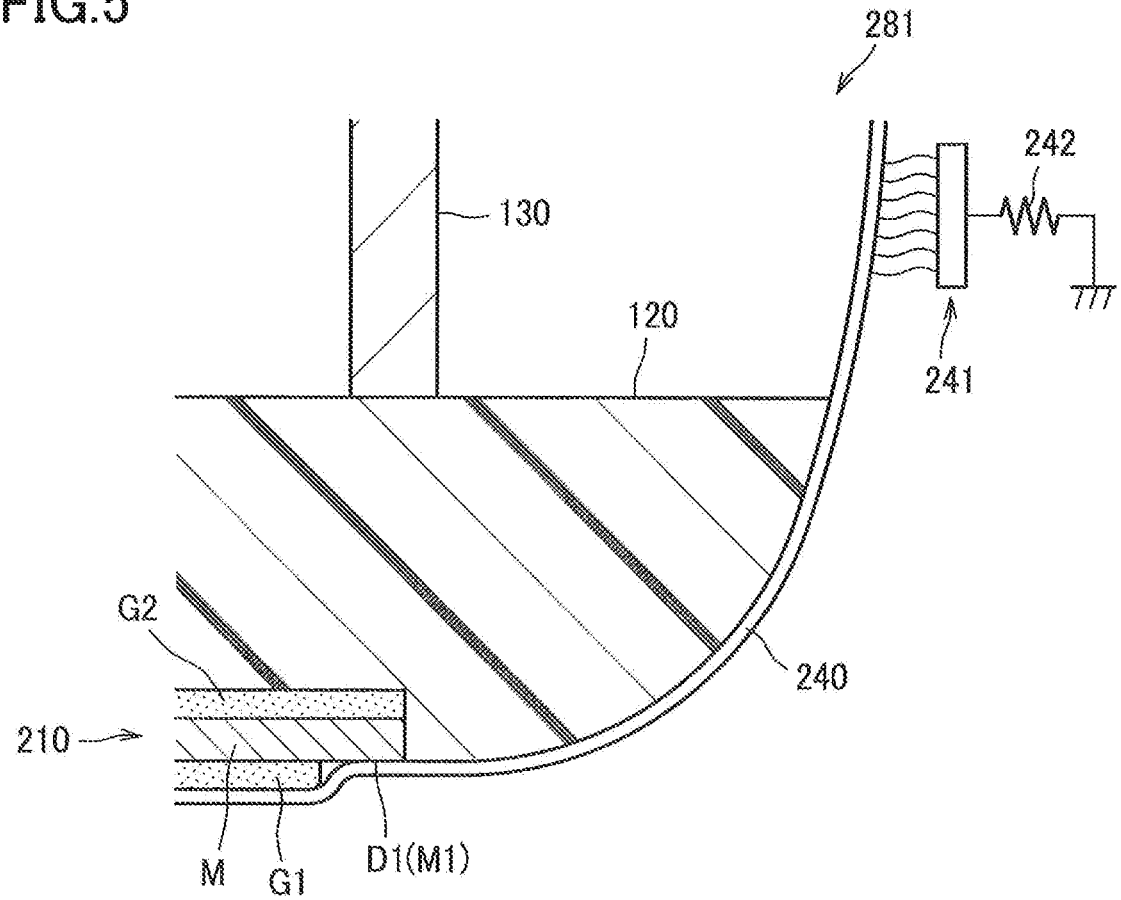
FIG. 5 is a view for explaining a grounding structure of a substrate in a second embodiment.

Specifically, the belt 240 has conductivity. More specifically, the belt 240 includes a metal raw tube formed of metal such as stainless steel, and a fluororesin layer covering the metal raw tube, and the fluororesin layer contains filler for applying conductivity to the fluororesin layer, for example. This enables the belt 240 to transmit electricity from an inner circumferential surface to an outer circumferential surface of the belt 240. A fixing device 208 includes a brush 241 being in contact with the outer circumferential surface of the belt 240. The brush 241 has conductivity and is grounded via a resistor 242. A portion of the first surface M1 of the substrate M has a first electrically-continuous portion D1 not covered with the first insulating layer G1. In other words, as illustrated in FIG. 5, the first electrically-continuous portion D1 is a portion of the first surface M1 of the substrate M which is located between the edge of the first insulating layer G1 in the longitudinal direction and the edge of the first surface M1 in the longitudinal direction. The substrate M is electrically connected to the belt 240 via the first electrically-continuous portion D1. The fluororesin layer is not provided at a portion of the metal raw tube of the belt 240 which is in contact with the brush 241, and the metal raw tube is electrically continuous to the brush 241. Thus, the substrate M of the heater 210 is grounded via the belt 240. This heater 210 reduces radiation noise by grounding the substrate M without connecting a grounding wire to the substrate.

Figure 6:
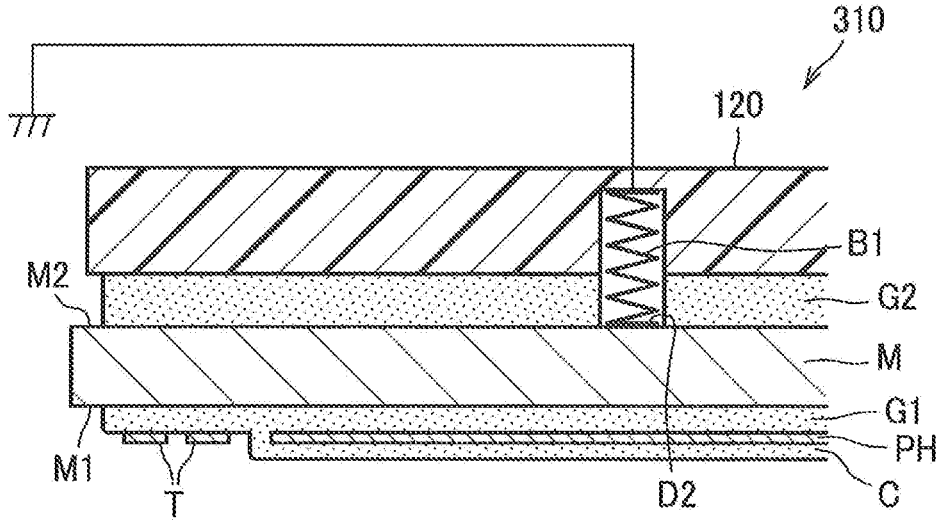
FIG. 6 is a view for explaining a grounding structure of a substrate in a third embodiment.

There will be next described a third embodiment. It is noted that the same reference numerals as used in the first embodiment are used to designate the corresponding elements of the third embodiment, and an explanation of which is dispensed with. While the grounding terminal ET for grounding the substrate M and the heating patterns PH are on the same side of the substrate M which is nearer to the first surface M1 than to the second surface M2 in the first embodiment, a portion for grounding the substrate M may be located on the second-surface-M2 side unlike the heating patterns PH. In a heater 310 in the third embodiment illustrated in FIG. 6, for example, the substrate M is grounded via the second surface M2 that is located on an opposite side of the substrate M from the first surface M1.

Specifically, the substrate M includes the second insulating layer G2 and a second electrically-continuous portion D2 provided on the second surface M2. The second electrically-continuous portion D2 is provided at a portion of the second surface M2 and not covered with an insulating layer. A conductive spring B1 is provided between the second electrically-continuous portion D2 and the holder 120. One end of the spring B1 is in electrical contact with the substrate M, and the other end is grounded. In the heater 310 in the third embodiment, the substrate M can be grounded via the second electrically-continuous portion D2 provided on the second surface M2 without hindrance of the grounding wire. This reduces radiation noise. It is noted that not only a coil spring but also any spring such as a leaf spring and a torsion spring may be employed for the spring B1.

Figure 7:
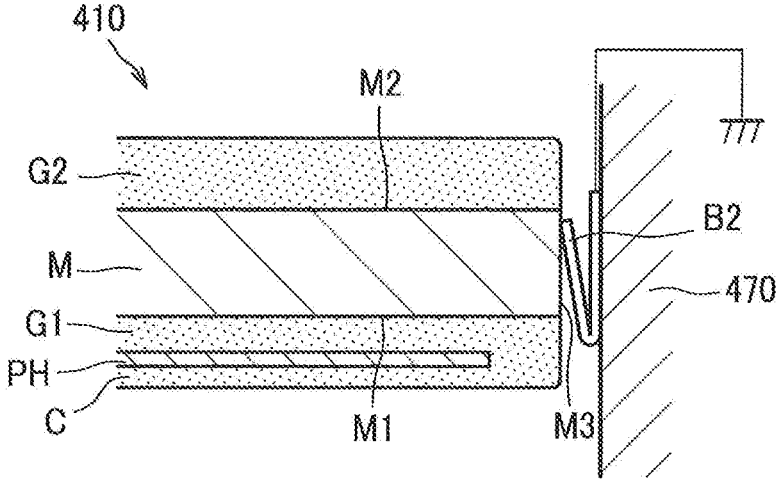
FIG. 7 is a view for explaining a grounding structure of a substrate in a fourth embodiment.

There will be next described a fourth embodiment. It is noted that the same reference numerals as used in the first embodiment are used to designate the corresponding elements of the fourth embodiment, and an explanation of which is dispensed with. The substrate may be grounded via an end face of the substrate. For example, in a heater 410 in the fourth embodiment illustrated in FIG. 7, the substrate M is grounded via an end face M3 of the substrate M.

Specifically, a connector 470 connected to the heater 410 includes a spring B2. The spring B2 is disposed between the connector 470 and the end face M3 of the substrate M. An urging force of the spring B2 brings the spring B2 and the substrate M into electrical contact with each other, thereby grounding the substrate M. The heater 410 in the fourth embodiment reduces radiation noise by grounding the substrate M. It is noted that not only a leaf spring but also any spring such as a coil spring and a torsion spring may be employed for the spring B2.

Figure 8:
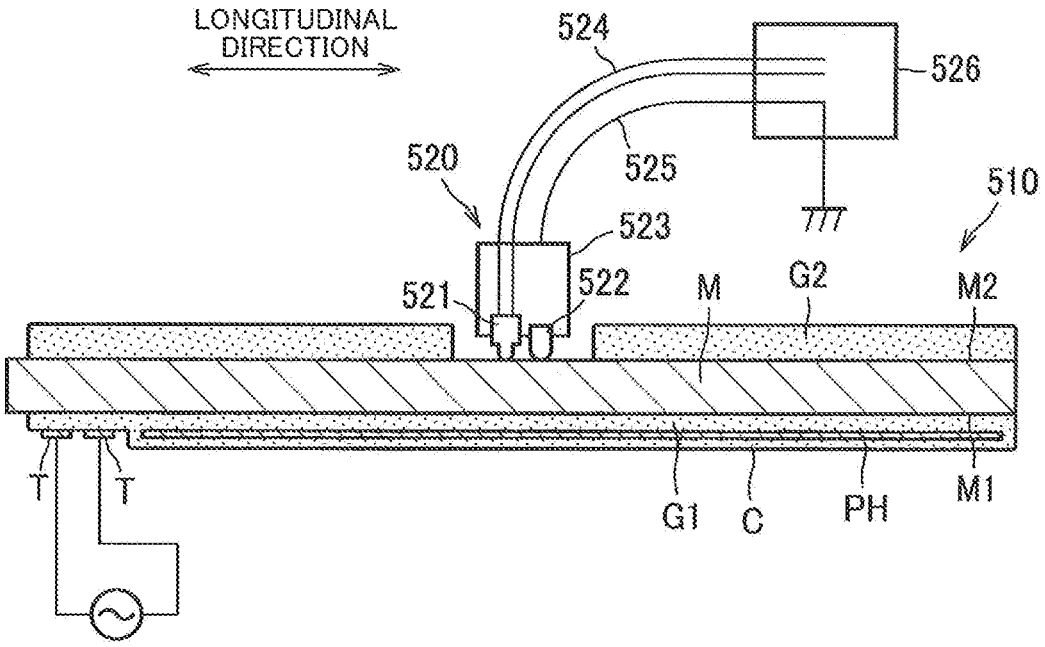
FIG. 8 is a view for explaining a grounding structure of a substrate in a fifth embodiment.

There will be next described a fifth embodiment. It is noted that the same reference numerals as used in the first embodiment are used to designate the corresponding elements of the fifth embodiment, and an explanation of which is dispensed with. The substrate is grounded via a wire of a temperature sensor. For example, in a fixing device according to the fifth embodiment illustrated in FIG. 8 includes a temperature sensor 520 configured to sense the temperature of the substrate M. The substrate M of a heater 510 is grounded via the wire of the temperature sensor 520.

Specifically, the temperature sensor 520 includes a temperature sensing portion 521, a grounding contact 522, a housing 523, a sensor wire 524, a ground wire 525, and a connector 526. The temperature sensing portion 521 and the grounding contact 522 are provided on the housing 523 and held in contact with the substrate M. The grounding contact 522 is electrically continuous to the housing 523 formed of metal and is grounded via the ground wire 525 connected to the housing 523. The sensor wire 524 connects the temperature sensing portion 521 and the connector 526 to each other. The ground wire 525 and the sensor wire 524 are covered with an insulating cover, not illustrated, so as to form a single code. The connector 526 is connected to a circuit board of a controller of the laser printer 1 and sends the controller a signal created by the temperature sensing portion 521. This heater 510 reduces radiation noise by grounding the substrate M without additionally providing a grounding wire.

While the embodiments have been described above, it is to be understood that the disclosure is not limited to the details of the illustrated embodiments, but may be embodied with various changes and modifications, which may occur to those skilled in the art, without departing from the spirit and scope of the disclosure.

While the protecting layer C is provided in the first embodiment, the present disclosure is not limited to this configuration, and the protecting layer C may not be provided. That is, the heating patterns may contact the belt.

While the surface of the heater 110 on which the heating patterns PH are formed is in contact with the belt 140 in the first embodiment, the present disclosure is not limited to this configuration. For example, a surface of the second insulating layer G2 on which the heating patterns PH are not formed in the heater 110 may contact the belt 140. This case does not require the protecting layer C for facilitating sliding on the belt 140.

While the grounding terminal ET is formed by plating with metal such as copper on the portion of the first surface M1 of the substrate M which is not covered with the first insulating layer G1 in the first embodiment, the substrate M may be exposed without plating.

While the substrate is formed of stainless steel in the first embodiment, the substrate may be formed of any of metal different from stainless steel, and alloy and may be formed of any material other than metal as long as the material has conductivity.

While the substrate of the heater 110 is a rectangular flat plate in the first embodiment, the shape of the substrate is not limited to the rectangular shape and may be any shape such as a polygonal shape and an oval shape.

While the present disclosure is applied to the laser printer 1 in the first embodiment, the present disclosure is not limited to this configuration. For example, the present disclosure may be applied to other types of image forming apparatuses, such as copying machines and multi-function peripherals.

The elements in the above-described embodiments and the modifications may be combined as needed.

What is claimed is:

1. A fixing device comprising:

a heater comprising (i) a substrate having conductivity, (ii) a first insulating layer provided on a first surface of the substrate, and (iii) a heating pattern constituted by a heating resistor and provided on an opposite side of the first insulating layer from the substrate; and an endless belt configured to rotate around the heater in a state in which an inner circumferential surface of the endless belt is in contact with the heater, wherein the substrate is grounded, wherein the substrate has a shape with a longitudinal direction, wherein the heater comprises two first terminals electrically continuous to the heating pattern, each of the two first terminals being connected to a power source, and a second terminal electrically continuous to the substrate, the second terminal being connected to a ground potential, wherein the second terminal and the two first terminals are located on a first-surface side of the substrate, and wherein the two first terminals and the second terminal are all located only at the first end portion of the substrate in the longitudinal direction.

2. The fixing device according to claim 1, wherein each of the two first terminals is disposed at a position that is nearer to a center of the substrate in the longitudinal direction than the second terminal.

3. A fixing device comprising:

a heater comprising (i) a substrate having conductivity, (ii) a first insulating layer provided on a first surface of the substrate, and (iii) a heating pattern constituted by a heating resistor and provided on an opposite side of the first insulating layer from the substrate; and an endless belt configured to rotate around the heater in a state in which an inner circumferential surface of the endless belt is in contact with the heater, wherein the substrate is grounded, wherein the endless belt has conductivity, and wherein the substrate comprises a direct-contact portion located at a portion of the first surface at which the first insulating layer does not exist, the direct-contact portion being directly in contact with the inner circumferential surface of the endless belt with the endless belt rotates.

4. The fixing device according to claim 3, wherein the substrate has a shape with a longitudinal direction, and wherein the direct-contact portion is formed on the portion of the first surface of the substrate, which portion is located between an edge of the first insulating layer and an edge of the first surface in the longitudinal direction.

5. A fixing device comprising:

a heater comprising (i) a substrate having conductivity, (ii) a first insulating layer provided on a first surface of the substrate, and (iii) a heating pattern constituted by a heating resistor and provided on an opposite side of the first insulating layer from the substrate; and an endless belt configured to rotate around the heater in a state in which an inner circumferential surface of the endless belt is in contact with the heater, wherein the substrate is grounded, wherein a temperature sensor is in contact with the substrate to sense a temperature of the substrate, and wherein the substrate is grounded via a wire of the temperature sensor.

* * * * *